US007204308B2

(12) United States Patent
Dudley et al.

(10) Patent No.: US 7,204,308 B2
(45) Date of Patent: Apr. 17, 2007

(54) BOREHOLE MARKING DEVICES AND METHODS

(75) Inventors: James H. Dudley, Spring, TX (US); Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 173 days.

(21) Appl. No.: 10/793,537

(22) Filed: Mar. 4, 2004

(65) Prior Publication Data

US 2005/0194132 A1 Sep. 8, 2005

(51) Int. Cl.
*E21B 47/09* (2006.01)

(52) U.S. Cl. ..... 166/254.1; 166/255.1

(58) Field of Classification Search ..... None
See application file for complete search history.

(56) References Cited

U.S. PATENT DOCUMENTS

| | | | | | |
|---|---|---|---|---|---|
| 2,337,269 | A | | 12/1943 | Piety | 255/1.8 |
| 2,350,832 | A | | 6/1944 | Segesman | 177/311 |
| 2,476,137 | A | | 7/1949 | Doll | 166/21 |
| 2,857,843 | A | | 10/1958 | Friend | 102/20 |
| 3,291,208 | A | | 12/1966 | Kenneday | 166/4 |
| 3,566,979 | A | | 3/1971 | Bennett et al. | 175/2 |
| 4,572,293 | A | | 2/1986 | Wilson et al. | 166/250 |
| 4,581,927 | A | * | 4/1986 | Johnson | 73/152.36 |
| 4,690,218 | A | | 9/1987 | Sumner | 166/297 |
| 4,879,900 | A | * | 11/1989 | Gilbert | 73/152.26 |
| 5,220,963 | A | | 6/1993 | Patton | 175/24 |
| 5,259,466 | A | | 11/1993 | Venditto et al. | 175/4.51 |
| 5,279,366 | A | | 1/1994 | Scholes | 166/254 |
| 5,310,013 | A | | 5/1994 | Kishino et al. | 175/44 |
| 5,318,123 | A | | 6/1994 | Venditto et al. | 166/250 |
| 5,341,886 | A | | 8/1994 | Patton | 175/24 |
| 5,360,066 | A | | 11/1994 | Venditto et al. | 166/250 |
| 5,386,875 | A | | 2/1995 | Venditto et al. | 166/308 |
| 5,419,405 | A | | 5/1995 | Patton | 175/27 |
| 5,439,064 | A | | 8/1995 | Patton | 175/24 |
| 5,505,260 | A | | 4/1996 | Andersen et al. | 166/278 |
| 5,753,813 | A | | 5/1998 | Hagiwara | 73/152.54 |
| 5,996,711 | A | * | 12/1999 | Ohmer | 175/61 |
| 6,028,534 | A | | 2/2000 | Ciglenec et al. | 340/856.2 |

(Continued)

OTHER PUBLICATIONS

Williamson, Hugh S., SPE BP Amoco, "Accuracy Prediction for Directional MWD," Society of Petroleum Engineers, SPE 56702, Presented at the 1999 SPE Annual Technical Conference and Exhibition, Houston, Texas, Oct. 3-6, 1999.

*Primary Examiner*—Zakiya W. Bates
(74) *Attorney, Agent, or Firm*—Baker Botts L.L.P.

(57) ABSTRACT

To reduce the surveying error in a wellbore, the creation of several reference points within a borehole is carried out by physically placing borehole markers in the borehole casing, the borehole wall or in the formation itself, and providing an accurate reference of the marker locations by either storing information specific to the borehole markers inside or on the marker itself, or assigning an identification number to the marker and storing the information relating to that identification number remotely in a database. The borehole markers may contain an electronic module which includes a microcircuit, a transponder dedicated to the transmission and reception of data to/from a detector placed on a wireline tool, a drill string or a coiled tubing. The detectors may have an additional role of interrogating the electronic modules.

32 Claims, 6 Drawing Sheets

U.S. PATENT DOCUMENTS

| | | | | |
|---|---|---|---|---|
| 6,070,662 | A | 6/2000 | Ciglenec et al. | 166/254.1 |
| 6,138,756 | A | 10/2000 | Dale | 166/254.2 |
| 6,151,961 | A | 11/2000 | Huber et al. | 73/152.54 |
| 6,321,839 | B1 | 11/2001 | Vereecken et al. | 166/250.16 |
| 6,467,387 | B1 | 10/2002 | Espinosa et al. | 89/1.15 |
| 6,499,537 | B1 | 12/2002 | Dewey et al. | 166/255.1 |
| 6,554,062 | B1 | 4/2003 | Dewey et al. | 166/50 |
| 6,629,562 | B1 | 10/2003 | Fidan | 166/99 |
| 6,648,069 | B2 | 11/2003 | Dewey et al. | 166/50 |
| 6,781,115 | B2 * | 8/2004 | Stoller et al. | 250/266 |
| 2002/0195276 | A1 | 12/2002 | Dubinsky et al. | 175/40 |
| 2003/0132224 | A1 | 7/2003 | Spencer | 219/635 |
| 2003/0173084 | A1 | 9/2003 | Fidan | 166/301 |
| 2004/0182147 | A1 * | 9/2004 | Rambow et al. | 73/152.14 |
| 2005/0024231 | A1 | 2/2005 | Fincher | |

* cited by examiner

BOREHOLE MARKING DEVICES AND METHODS

FIELD OF THE INVENTION

The present invention pertains generally to the field of equipment and operations utilized in investigating subterranean formations. More particularly, the invention relates to apparatus and methods for locating a position in a borehole using embedded borehole markers. The invention may be used to measure the location of a device in a borehole using borehole markers embedded in a borehole casing, a borehole wall or a particular formation.

BACKGROUND OF THE INVENTION

The search for oil and other hydrocarbons has led in recent years to more and more complex oil wells. Frequently, techniques such as geosteering are used to direct a well to a precise location in the subsurface.

Geosteering often relies on natural markers, such as formation boundaries, to confirm that the borehole is proceeding as planned. The formation boundaries are predicted from seismic surveys or from nearly offset wells. Geosteering can be adversely affected if the natural markers are not where they are predicted to be. This can happen, for example, for the following reasons:

interpolation/extrapolation errors from offset wells;

different sensors with different spatial resolutions; and accumulation of small surveying errors which can happen even if the borehole is surveyed at every tool joint.

The effect of such errors on geosteering can be dramatic. Assume that the formation of interest is located about 10,000 feet deep in a well which has been drilled to a depth of 9,000. Assume further that location errors have accumulated to a total error of 1%. This combination of factors may produce an error of 90 feet, which might be larger than the thickness of a formation of interest. Any measurement error of this magnitude could easily cause the perforation to completely miss the location of a target formation.

BRIEF DESCRIPTION OF THE DRAWINGS

A more complete understanding of the present disclosure and advantages thereof may be acquired by referring to the following description taken in conjunction with the accompanying drawings wherein.

Figure 1:
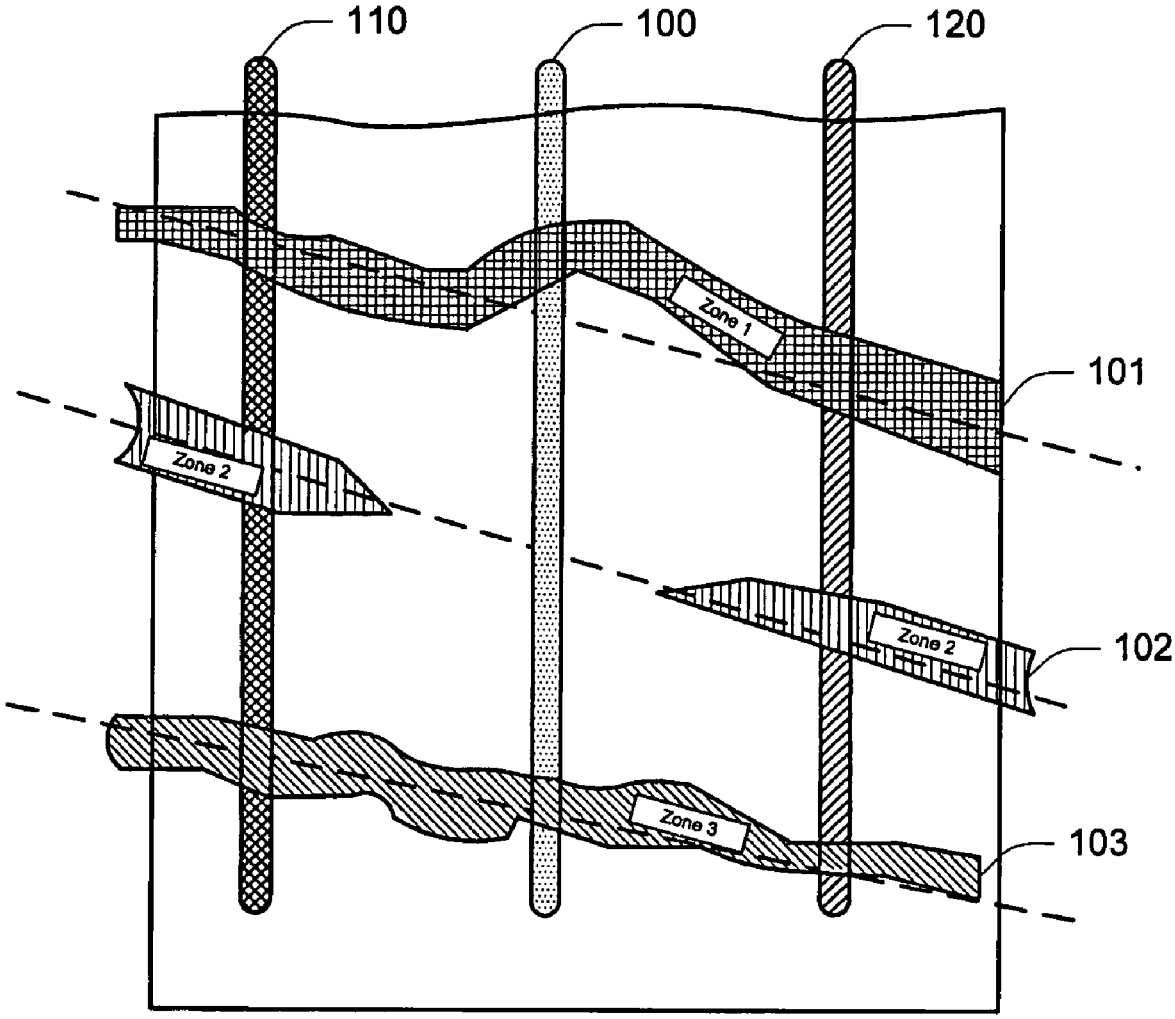
FIG. 1 illustrates possible errors that arise when a subterranean formation tool is positioned using the geosteering method.

The present invention may be susceptible to various modifications and alternative forms. Specific embodiments of the present invention are shown by way of example in the drawings and are described herein in detail. It should be understood, however, that the description set forth herein of specific embodiments is not intended to limit the present invention to the particular forms disclosed. Rather, all modifications, alternatives and equivalents falling within the spirit and scope of the invention as defined by the appended claims are intended to be covered.

DESCRIPTION OF THE PREFERRED EMBODIMENT

The present invention reduces the uncertainty of locating a bit, a tool or other devices or points of interest, for example, a bed boundary, in a wellbore by placing one or more markers at known reference points in a borehole rather than using a single reference point at the surface of the earth. By using known reference points within the borehole, it is possible to reduce surveying errors which tend to accumulate.

Conventionally, outputs from real time downhole data are correlated with expected outputs based either on offset wells or on a vertical section of wells through the same zones with the same pilot hole. The identification of geological markers with depth is imprecise because it is difficult to predict the location of these markers with certainty based on logs obtained, for example, from offset wells.

Exemplary problems that can arise when using this technique are illustrated in FIG. 1 where subterranean formations are divided into three different zones: zone 1 referred to as 101, zone 2 referred to as 102, and zone 3 referred to as 103. A zone can be defined as an interval or unit of rock differentiated from surrounding rocks on the basis of its mineral content or other features, such as faults or fractures.

As shown in FIG. 1, two reference wells, reference well A 110 and reference well B 120, and a well under investigation 100 are drilled into the subterranean formation. The three zones 1, 2 and 3 are traversed by reference well A 110 and reference well B 120. However, only zone 1 and zone 3 are traversed by the well 100 under investigation.

Zone 1 in FIG. 1 is assumed to be planar, but it is not. In this case, the expected intersection of the well under investigation 100 with Zone 1 is considerably beneath where the intersection actually occurs. When this is observed, the driller must decide if the deviation is due to surveying error or an unexpected change in the geology.

Zone 2 in FIG. 1 is also assumed to be a continuous plane. Instead, it thins out and disappears between the two reference wells. Thus, the expected intersection between Zone 2 and the well under investigation does not occur.

Since Zone 3, in this case, is similar to Zone 2, when Zone 3 is finally crossed by the well under investigation 100, it may appear to the operator located at the surface that the well under investigation has crossed into Zone 2, potentially leading the operator to make a serious depth error. This problem may be corrected after several zones have been penetrated and it becomes clear from the spatial pattern of the observed zones that Zone 2 has thinned out, but by that time, a considerable portion of the well has been drilled.

Figure 2:
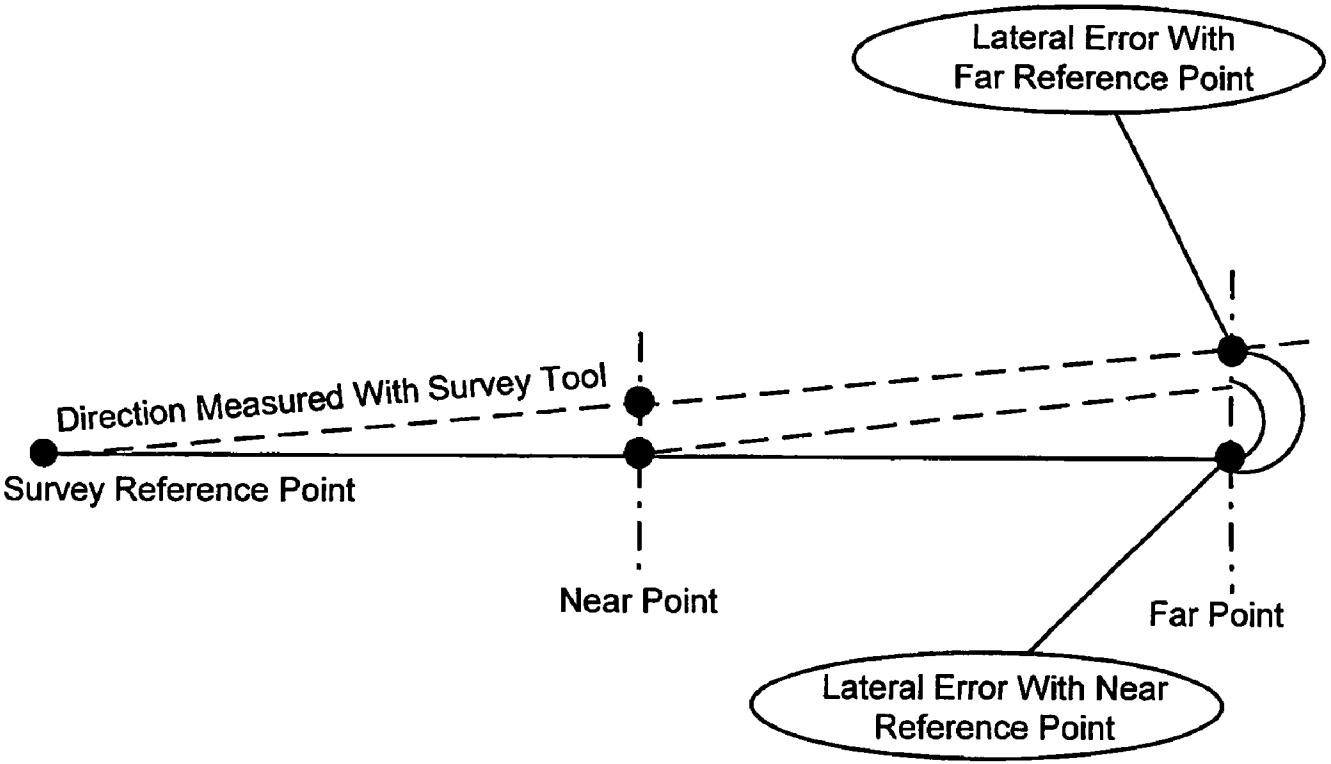
FIG. 2 illustrates error accumulation with distance.

The use of these zones as markers can lead to errors in drilling or investigating the well 100. FIG. 2 illustrates the significant lateral error that might result from the use of a survey reference point situated, for example, at the surface of the earth to position a far distant point situated deep in the wellbore. In the above example and also in the real world, if the near point is used as the survey reference point, then the surveying error to the far point is greatly reduced. One embodiment of the present invention places markers at one or more locations in the borehole to create near points to reduce surveying error.

Therefore, to reduce the surveying error in a wellbore, the creation of each reference point within a borehole is carried out in two steps:

Physically placing a marker in the borehole wall or in the formation; and

Providing an accurate reference of the marker location by either storing the reference information in or on the marker itself, or assigning a reference or identification number to the marker and storing the information relating to that identification number remotely, for example, in surface equipment.

Figure 3A:
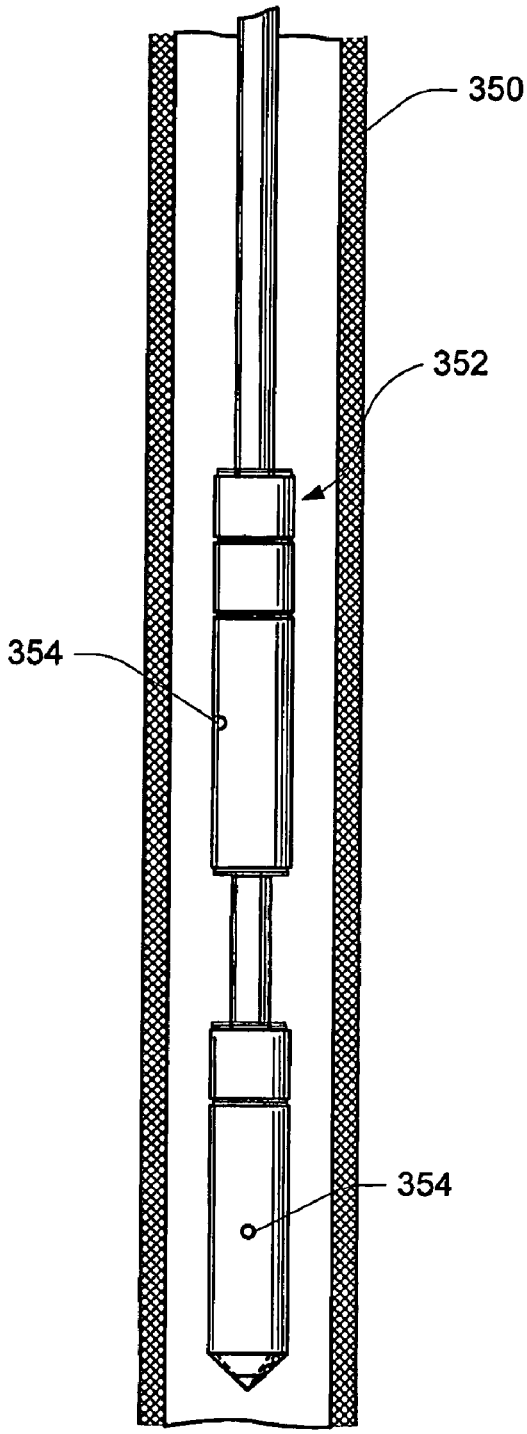
FIG. 3A shows a suspended drill string in a subterranean formation from which markers may be affixed to a borehole casing, or implanted into a borehole wall or a subterranean formation.

The markers can be attached to the borehole casing, or placed in the borehole wall or in the formation itself. The marker placing can be performed by a tool lowered into the borehole, for example, in a drill string or by a wireline tool. FIG. 3A shows a drill string 352 in a subterranean formation with a placement device 354 from which markers may be attached to the borehole wall 350 or injected into the subterranean formation. The markers could be placed when the drill string stops rotating, for example, when tripping into or out of the borehole. In one embodiment, the placement device 354 is a gun and the markers are fired into the borehole casing, the borehole wall or in the formation using explosive charges.

An operator located at the surface can manipulate the suspended drill string 352 in order to determine from the surface the depth and azimuthal orientation of the marker. As is shown in FIG. 3A, two or more placement devices 354 may be located in two different segments of the drill string to allow simultaneous placement of more than one marker in the borehole wall 350. In a particular embodiment, the lower placement device 354 can place one type of marker, for example, radioactive marker, while the upper placement device 354 can place another type of marker, for example, one that contains an electronic module. Markers can be of any type as will be described below, and any combination of these types of marker can be placed from these two placement devices 354.

It should also be kept in mind that more than two guns or other types of placement device 354 can be used for placing markers. In the same way, each placement device can be equipped with a plurality of apertures from which markers may be placed into the borehole casing, the borehole wall or the formation itself.

In another embodiment, the placement devices 354 can rotate independently of the rest of the drill string in order to place markers in the appropriate location. The azimuthal orientation as well as the depth of the marker locations can be either defined manually by the operator or automatically by the placement device 354 in association with sensor(s) or detector(s) located in the proximity of the placement devices 354. The placement devices 354 can place these markers when a specific zone of the borehole is encountered or when a particular depth is reached. The types of detectors that can be used are further described below.

In another embodiment, a marker is placed at the bottom of each borehole casing.

Figure 3B:
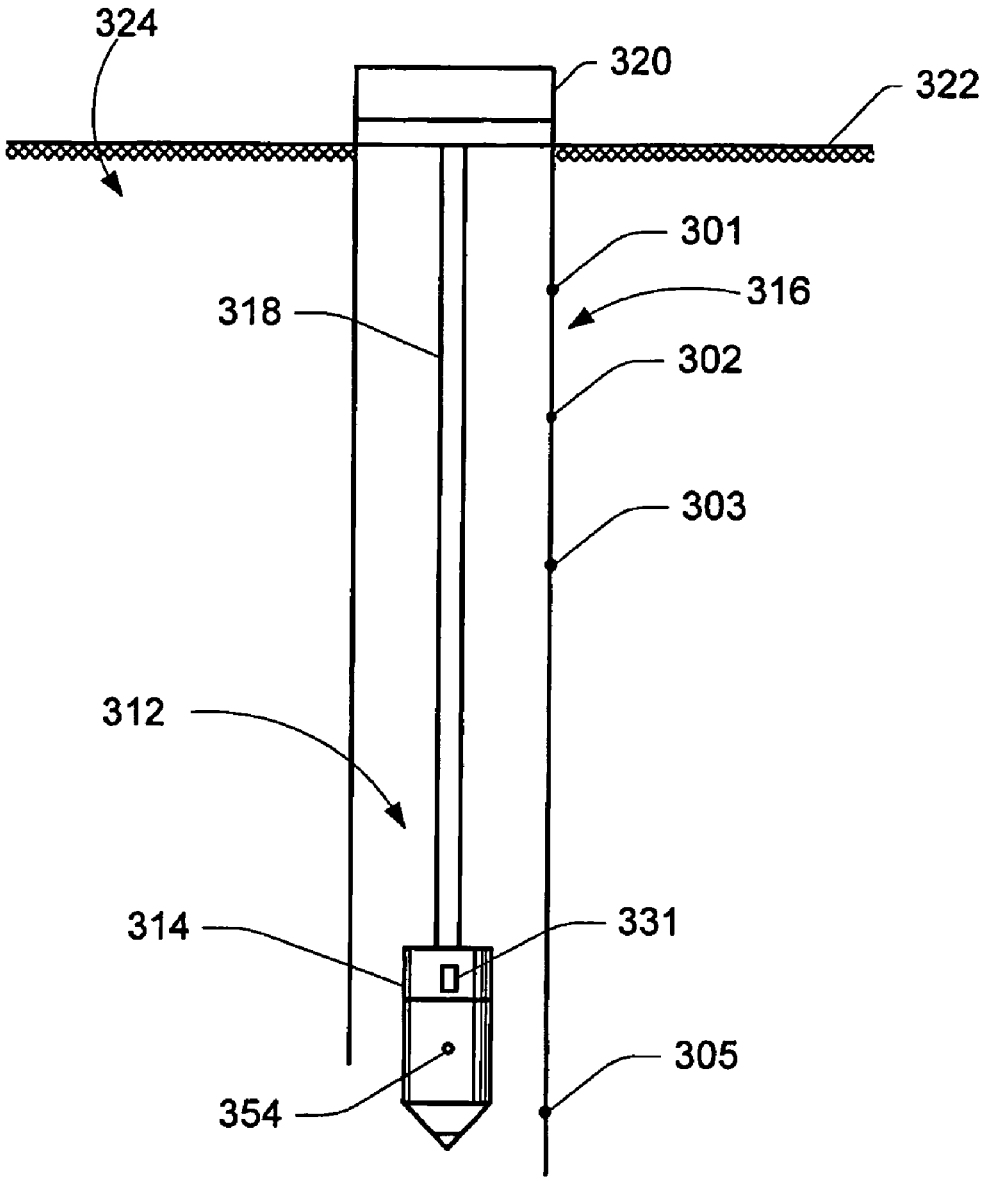
FIG. 3B shows a suspended wireline tool in a subterranean formation used for monitoring marker locations or for placing additional markers.

A device for identifying the location of markers already placed in the borehole is depicted in FIG. 3B. As shown, a plurality of markers 301, 302, 303, and 305 have all been placed in the borehole. These markers may be attached to a borehole casing 316 or embedded in a borehole wall or in the subterranean formation itself. A wireline tool 312 is used to determine the location of each marker below a surface 322 of a subterranean formation 324. Attached to a cable 318, the wireline tool 312 is lowered into the borehole where it is substantially surrounded by a borehole casing 316. The wireline tool 312 preferably includes a tool housing 314 that supports one or more detectors 331 and may include one or more placement devices 354. The detector 331 may be located on the surface of the tool housing 314 or inside the tool housing 314 behind a protective window. The wireline tool 312 is suspended by the cable 318 that also provides an electrical connection between the wireline tool 312 and the surface equipment 320. The cable 318 also contains wires that receive or transmit signals between the wireline tool 312 and the surface equipment 320. The surface equipment 320 informs the operator of the environment that surrounds the tool housing 314, including, for example, the depth of the wireline tool 312 in the borehole.

Figure 5:
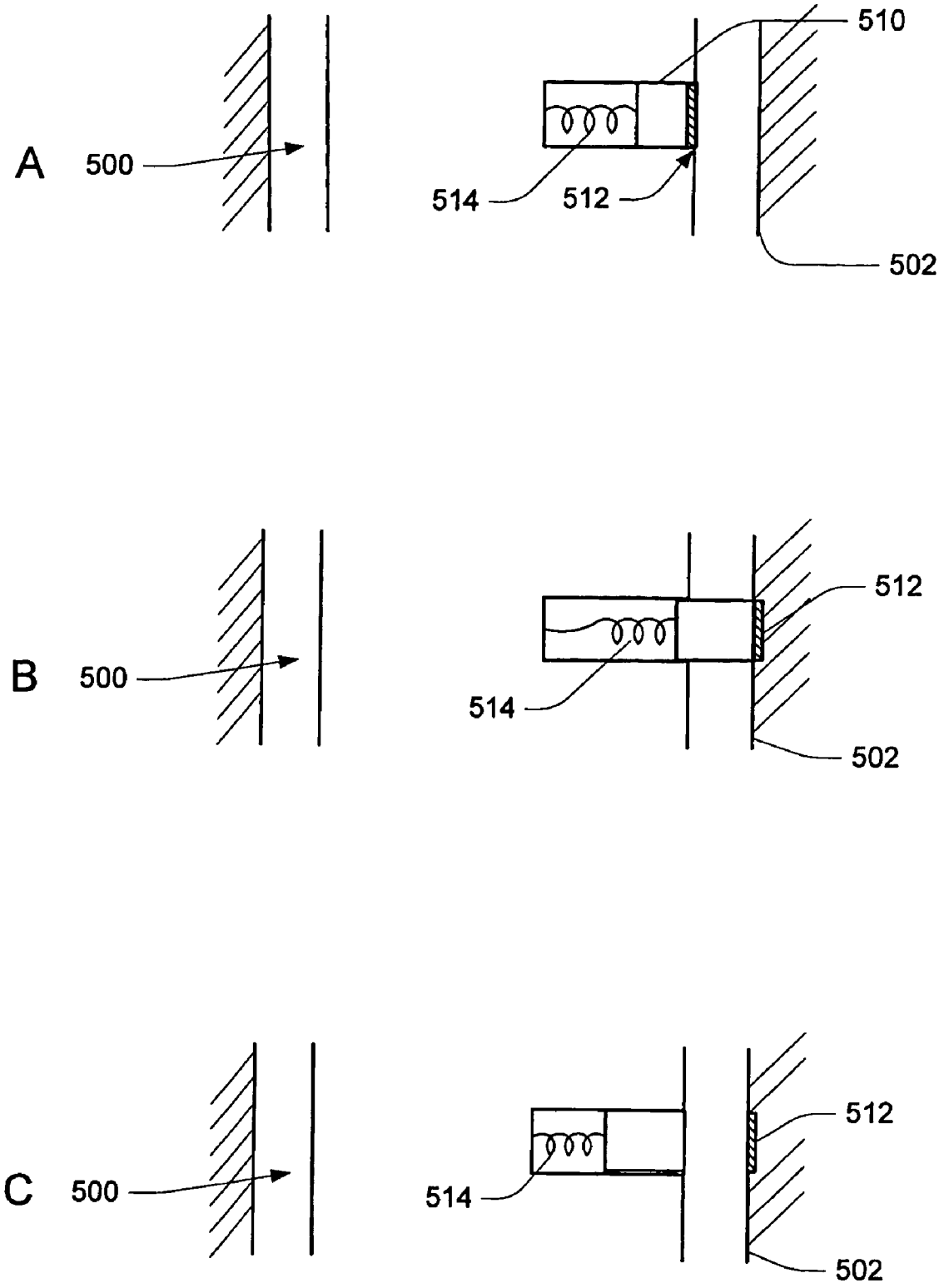
FIGS. 5A, 5B and 5C show a modified formation tester being used for placing markers in a borehole.

Another way a marker can be placed in the borehole wall is to modify a downhole formation pressure measurement tool, such as the GEOTAP, a tool manufactured by Halliburton, so that in addition to making a formation pressure measurement, a marker is pressed into the formation when the pressure measurement snorkel is pressed against the formation. As shown in FIGS. 5A, 5B and 5C, a formation tester 500 operates by extending a snorkel 510 with a sealing pad at its end against the borehole wall. The formation tester runs tests using instruments included in the snorkel. The formation tester would be modified so that as the snorkel is extended, a marker 510 is placed into a borehole wall 502. The markers may be pushed deeper into the borehole wall and into the formation using, for example, a spring 514 to provide additional force.

The three different stages of operation performed by the snorkel are particularly shown in FIGS. 5A, 5B and 5C. FIG. 5A illustrates the snorkel 510 pressed against the borehole wall 502. FIG. 5B illustrates the spring 514 extended to push a marker 512 against the borehole wall. FIG. 5C illustrates the retraction of the spring 514 leaving the marker 512 affixed to the borehole wall 502.

Markers may comprise:

An electronic module containing a transponder with or without a battery module and/or an identifying memory;

Metal, such as steel;

A permanent magnet; and

A low level radioactive source, preferably one with a short lifetime.

To reference and identify markers in a borehole, it is possible to assign an identification number to each marker and to store all the information corresponding to the identification numbers in a database, for example, physically located in the surface equipment 320. In one particular embodiment, the operator can have access directly to the database and make all the queries and the changes required for proper identification of the markers.

In one embodiment, the placement devices 354 can place a selected combination of different types of markers in each location in the borehole. Each combination of types of markers is unique and specific combinations identify specific locations in the wellbore. For example, at one location, there is a unique metal marker which represents that location. At the next location there is a metal marker combined with a magnetic marker, both of them together representing that location. All along the borehole, there may be different and unique combinations of different types of markers so that each unique combination enables identification of each location of the borehole.

Furthermore, in another embodiment, each type of marker can represent a number and more specifically a digit. For example, the metal markers represent the units, the magnetic markers represent the tens, the radioactive markers represent the hundreds. Therefore, the location marked by the selected combination of a metal marker, a magnetic marker, and a radioactive marker represents the identification number 111.

In one embodiment, an electronic module may comprise a marker. The marker may then be provided with a device for the reception and transmission of electromagnetic waves or signals, such as an antenna, which is coupled to the electronic module. The electronic module processes the received signals and causes responsive signals to be transmitted. The received signals may represent, for example, a message to identify the marker and hence the subterranean formation or the specific zone to which the marker is affixed. The message may also contain other information or data that the operator wishes to store in a dedicated memory that is provided with the electronic module. The transmitted signals may include information from the module that may be useful to the operator.

As previously illustrated in FIG. 3B, the wireline tool 312 has one or more detectors 331 that may comprise a device for the transmission/reception of electromagnetic waves, signals or data, first, between the electronic modules and the detectors, and second, between the detectors and the surface equipment 320 located at the surface. The detectors are capable of reading information contained in each electronic module and writing information into each electronic module should the latter be provided with a memory.

In one embodiment, the electronic modules have built-in transponders and are generally deployed all along the borehole casing, borehole wall or the formation itself. They can also be deployed in all azimuthal orientations in another embodiment.

Each electronic module contains a memory and is used as a reference point in subsequent drilling. The memory may contain, for example, indications of the module identification, the module location, the type of geological formation that surrounds the module and other data that might be of interest. The memory is erasable and may be re-written so that additional information or updated information can be registered in each one of the electronic modules.

Alternatively, the marker memory may just include a marker identification (e.g., "I am marker 12") which may be correlated with information stored in a system database accessible by the operator located at the surface through the surface equipment 320.

The detector fulfills several functions and is notably used for transmitting power to the marker if the marker is not equipped with an independent source of power. The detector may also send data received from the surface equipment 320 to the electronic module. The data may be recorded in a memory provided with the electronic module for retrieval in a subsequent pass by the detectors. Furthermore, the detector can read data contained in the electronic module and use this data to identify the marker and the electronic module.

It should also be kept in mind that the features described with respect to FIG. 3B for a wireline tool also apply to a drill string or coiled tubing. The detectors can be also arranged on a segment or more than one segment of the drill string.

Figure 4:
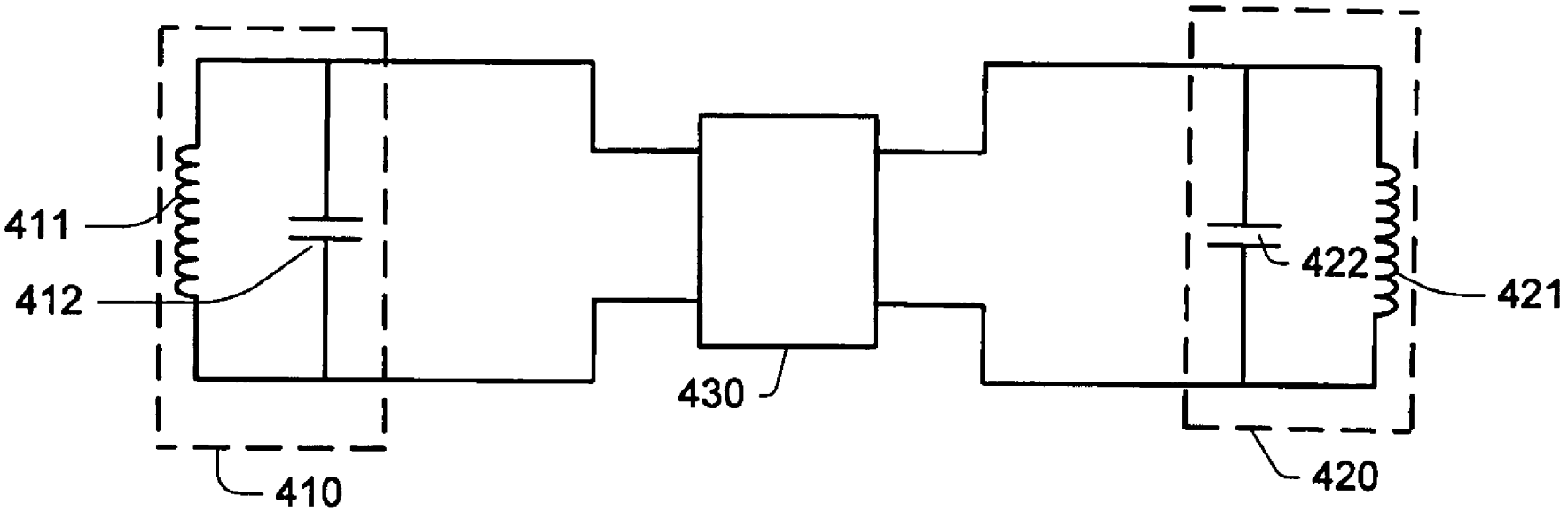
FIG. 4 is an example of electronic tag or microchip that may comprise a marker.

As illustrated in FIG. 4, a combination of an antenna 411, here represented as an inductor, and a capacitor 412 form an energizing circuit 410. Each marker may contain the energizing circuit 410 wherein the capacitor may be connected to a microcircuit 430. The microcircuit 430 may contain a system which may extract from the signals received by the energizing circuit 410 electrical energy for powering the microcircuit 430. Furthermore, the microcircuit 430 may also contain circuits that can receive and generate electrical signals or data which are dependent on the data stored within the microcircuit itself.

In another embodiment, instead of having an energizing circuit 410, the microcircuit 430 is connected directly to a battery that can provide power and enables the microcircuit to communicate with the detector of the wireline tool once it has detected its presence.

The microcircuit 430 is also connected to a detection circuit such as a tuned circuit 420 including an antenna 421 and a capacitor 422.

In one embodiment, the electronic module may be similar to an EZ tag module used on highways to identify vehicles. This EZ tag module can then be interrogated by a detector on the wireline tool or by the tool in the drill string, and identify itself with a unique identification or reference number. Such an EZ tag module allows assignment of a unique identifier to such a module and the use of the module's memory to store data relevant for the drilling and the production of the wellbore.

Depending on the types of markers that are being used or the combination of types of markers such as a piece of metal, a permanent magnet, a radioactive source, or an electronic module, suitable detector(s) may be included in the wireline tool 312 so that these markers may be detected.

Furthermore, a wireline tool 312 having both one or more detectors 331 and one or more placement devices 354 can be built in such a way that the segment of the wireline tool on which the detectors 331 are fixed can rotate independently from the segment on which the placement devices 354 are fixed. The detectors 331 and placement devices 354 can also be fixed on more than one segment of the wireline tool.

In an embodiment where the markers are pieces of metal, the detector can be a simple electromagnetic sensor.

In another embodiment where the markers contain a permanent magnet, a single axis magnetometer could be used as a detector and placed in the wireline tool 312. The permanent magnet emits a permanent magnetic field that can be detected by the appropriate detectors without raising any concern about the life of the permanent magnet.

In another embodiment, the markers may contain radioactive sources, for example a $Cs^{137}$ source, such that gamma ray detectors placed in the wireline tool 312 can detect the presence of the marker. A $Cs^{137}$ source has a half life of about 30 years allowing the markers to be monitored over about a 5–15 years period.

Finally, in another embodiment where the markers contain electronic modules with transponders, they can be located by continually interrogating the borehole using an electromagnetic transmitter and receiver in the wireline tool or the drill string.

The markers once set, can be used for locating a device that is lowered in the borehole. The device can be on a drill string, a wireline tool or coiled tubing. The determination of the location of the device is performed by determining the location of the nearest marker or markers as a reference point or reference points, and afterwards by estimating or calculating the distance between the nearest marker or markers and the device in order to finally determine the total distance between the surface and the device itself. This determination of the total distance can be automatically computed in real time or at the request of the operator.

In another implementation, the markers that are set can be used as a relative surveying reference. During a drilling trip, a survey tool, for example, one with a gyroscope, can be used to make a precise identification of the marker location.

If a gyroscope is used, it would preferentially be used while tripping in since many of the measurement errors from a gyroscope increase with the time since the gyroscope was last oriented to a known reference position. Once the precise location of the reference marker is established, all measurements can be referenced to it, thus reducing the uncertainty in the location of geological markers.

The invention, therefore, is well adapted to carry out the objects and to attain the ends and advantages mentioned, as well as others inherent therein. While the invention has been depicted, described and is defined by reference to exemplary embodiments of the invention, such references do not imply a limitation on the invention, and no such limitation is to be inferred. The invention is capable of considerable modification, alternation and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A system for locating a position in a subterranean formation comprising:

a plurality of borehole markers, each one having a unique identification;

a tool having one or more detectors; and surface equipment adapted to receive signals from the detector(s) responsive to the detection of a borehole marker for use as a reference point;

wherein one or more borehole markers comprise an electronic module comprising a memory which stores the identification information specific to the associated borehole marker.

2. The system according to claim 1 wherein the location of the borehole marker is used for an estimation of the distance between a surface and the reference point.

3. The system according to claim 1 wherein a database stores the identification information of the borehole markers and their locations.

4. The system according to claim 1 wherein one or more borehole markers comprise metal.

5. The system according to claim 1 wherein one or more borehole markers comprise a permanent magnet.

6. The system according to claim 1 wherein one or more borehole markers comprise a radioactive source.

7. The system according to claim 1 wherein the electronic module further contains a transponder and a battery.

8. The system according to claim 1 wherein the electronic module further comprises a transponder with an energizing circuit.

9. The system according to claim 1 wherein a borehole marker comprises a combination of metal, magnet or radioactive markers which identifies a specific marker.

10. A method of locating a position in a subterranean formation containing a plurality of borehole markers, comprising the steps of:

lowering a tool having one or more detectors along the borehole of the subterranean formation from the surface; and detecting a borehole marker having a unique identification, wherein one or more borehole markers comprise an electronic module comprising a memory which stores the identification information specific to the associated borehole marker.

11. The method according to claim 10 comprising determining the location of the borehole marker from a database which stores the identification information of the borehole markers and their locations.

12. The method according to claim 10 wherein one or more borehole markers comprise metal.

13. The method according to claim 10 wherein one or more borehole markers comprise permanent magnets.

14. The method according to claim 10 wherein one or more borehole markers comprise a radioactive source.

15. The method according to claim 10 wherein the electronic module further comprises a transponder and a battery.

16. The method according to claim 10 wherein the electronic module further comprises a transponder with an energizing circuit.

17. The method according to claim 10 wherein a borehole marker comprises a combination of metal, magnet or radioactive markers which identifies a specific marker.

18. A system for utilizing borehole markers to mark a borehole of a subterranean formation comprising:

a tool containing one or more detectors for detecting the borehole markers;

surface equipment adapted to receive signals from the detector(s); and one or more placement devices for placing borehole markers, each borehole marker having a unique identification, wherein one or more borehole markers comprise an electronic module comprising a memory which stores the identification information specific to the associated borehole marker.

19. The system according to claim 18 comprising a plurality of borehole markers placed at the bottom of each borehole casing.

20. The system according to claim 18 wherein a database stores identification information specific to the associated borehole markers and their locations.

21. The system according to claim 18 wherein one or more borehole markers comprise metal.

22. The system according to claim 18 wherein one or more borehole markers comprise permanent magnets.

23. The system according to claim 18 wherein one or more borehole markers comprise a radioactive source.

24. The system according to claim 18 wherein the electronic module further comprises a transponder and a battery.

25. The system according to claim 18 wherein the electronic module further comprises a transponder with an energizing circuit.

26. The system according to claim 18 wherein a borehole marker is a combination of metal, magnet or radioactive markers which identifies a specific marker.

27. The system according to claim 18 wherein the tool comprises a plurality of segments, at least one segment containing one or more placement devices.

28. The system according to claim 27 comprising segments which can rotate independently from the rest of the tool along the borehole axis to place borehole markers in the borehole or to detect borehole markers embedded in the borehole.

29. The system according to claim 18 wherein a placement device comprises a formation tester.

30. The system according to claim 18 wherein a placement device comprises a snorkel.

31. A downhole marker placement tool comprising a formation measurement tool adapted to be used for placing a borehole marker at a location where the measurement is being performed, wherein one or more borehole markers comprise an electronic module comprising a memory which stores the identification information specific to the associated borehole marker.

32. The downhole marker placement tool of claim 31 further comprising a snorkel.

* * * * *